US005144695A

United States Patent [19]

Schweizer

[11] Patent Number: 5,144,695

[45] Date of Patent: Sep. 8, 1992

[54] BASEBALL CAP RETENTION DEVICE

[76] Inventor: George W. Schweizer, 14 Glenworth Ct., Manchester, Mo. 63011

[21] Appl. No.: 790,913

[22] Filed: Nov. 13, 1991

[51] Int. Cl.[5] ..... A42C 5/00

[52] U.S. Cl. ..... 2/189; 2/185 R; 2/199

[58] Field of Search ..... 2/189, 185 R, 199, 188, 2/421; 132/59, 58, 57.1; 24/3 R, 3 C, 3 L, 3 B, 3 J, 3 M

[56] References Cited

U.S. PATENT DOCUMENTS 867,814 10/1907 Fornander ..... 2/189
938,281 10/1909 Shaw ..... 132/58
1,406,622 2/1922 Donlin ..... 132/58
2,339,077 1/1944 Hoffeld ..... 132/58
3,109,176 11/1963 Schuessler ..... 2/201
4,841,576 6/1989 Beagley ..... 132/58
4,991,236 2/1991 Pritchett ..... 2/189

*Primary Examiner*—Werner H. Schroeder
*Assistant Examiner*—Gloria Haw
*Attorney, Agent, or Firm*—Henderson & Sturm

[57] ABSTRACT

A retaining device (10) for headwear (100); wherein, the device comprises a pair of tether members (20) operatively connected together by a slide members (30) and provided on one end with clip elements (40) having spring loaded jaws (41) which captively yet releasably engage selective portions of the headwear (100).

4 Claims, 1 Drawing Sheet

BASEBALL CAP RETENTION DEVICE

BACKGROUND ART

This invention was the subject matter of Document Disclosure Program Registration No. 281,589 which was filed in the United States Patent and Trademark Office on May 13, 1991.

As can be seen by reference to the following U.S. Pat. Nos. 4,991,236; 3,109,176; 938,281; and 1,406,622; the prior art is replete with myriad and diverse hat and cap retention devices.

While all of the aforementioned prior art constructions are more than adequate for the basic purpose and function for which they have been specifically designed, these patented constructions are uniformly deficient with regard to the fact that they either employ a quasi-permanent connection with the headwear, or they are relatively difficult to attach and disengage relative to the headwear.

In addition, with rare exception, the prior art devices are not readily attached to both the headwear and a disparate article of clothing.

As a consequence of the foregoing situation, there has existed a longstanding need among parents in particular for a new type of headwear retaining apparatus that their children will find very simple to operate and which will secure the headwear either to the child or the child's apparel in windy conditions, or during periods of frenzied activity; and the provision of such a construction is a stated objective of the present invention.

DISCLOSURE OF THE INVENTION

Briefly stated, the headwear retaining device that forms the basis of the present invention comprises in general a pair of flexible tether members provided with spring loaded clip elements on one end; wherein, the intermediate portions of the tether members are captively received in a slide member which may optionally be provided with a locking mechanism.

In addition the clip elements are dimensioned to releasably yet captively receive the periphery of the skull cap portion of the headwear; wherein, at least one of the clip elements is also adapted to releasably yet captively engage a portion of a disparate article of outerwear clothing.

As will be explained in greater detail further on in the specification, while the particular device that forms the subject matter of the present invention was specifically designed for use with children's billed caps; this particular device is equally suited for use on an adults billed cap; particularly while fishing, since most bass fishermen now have to resort to turning the bills of their caps in a rearwardly facing direction, while they are running their boats at high speed from one fishing location to another.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
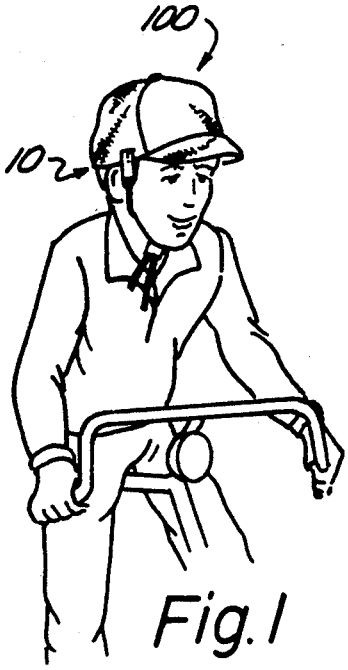
FIG. 1 is a perspective view of the headwear retaining device of this invention being worn in its intended manner.
Figure 2:
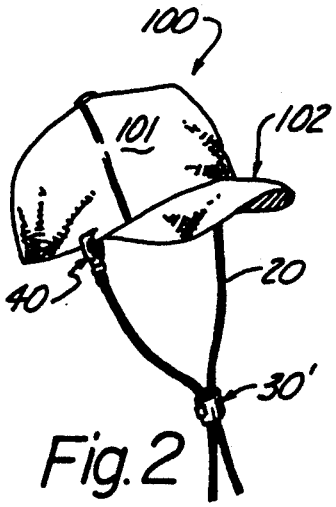
FIG. 2 is an isolated perspective view of the headwear retaining device engaged with a billed cap.

As can be seen by reference to the drawings, and in particular to FIGS. 1 and 2 the headwear retaining device that forms the basis of the present invention is designated generally by the reference numeral (10). The device (10) comprises in general a pair of flexible tether members (20) operatively connected to one another by a slide member (30); wherein, one end of each of the flexible tether members (20) are further provided with a clip element (40).

Figure 4:
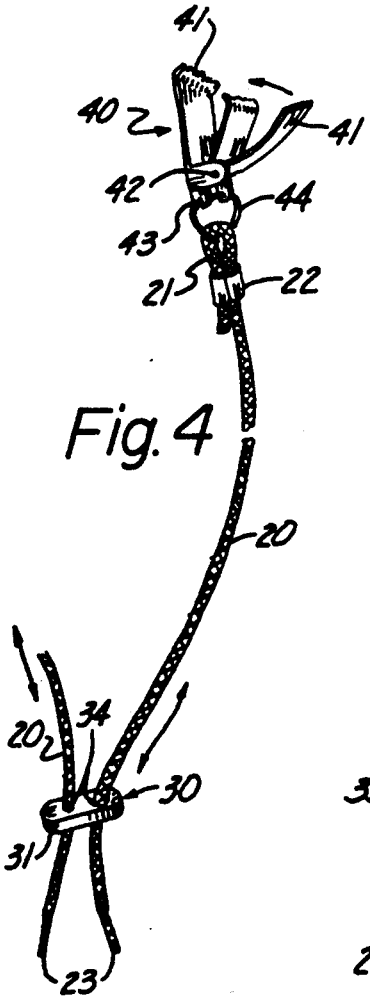
FIG. 4 is an isolated detail view of a substantial portion of the headwear retaining device; and, FIG. 5 is an isolated perspective view of one of the slide members envisioned for use with this invention.

As can best be seen by reference to FIG. 4, each of the elongated flexible tether members (20) have a loop (21) formed on one end; wherein, the loop (21) is created by doubling one end of the flexible tether member (20) back on itself, and connecting the opposed portions of tether member (20) with a conventional crimped collar element (22).

Figure 3:
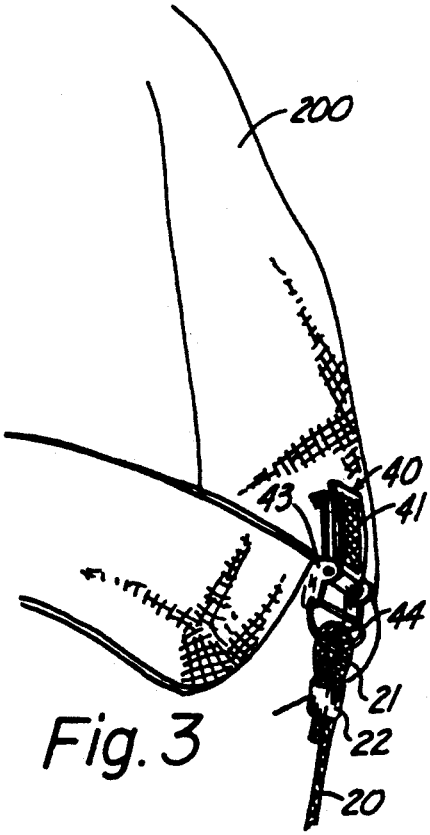
FIG. 3 is an isolated detail view of one of the spring clip elements engaged with a disparate article of clothing.

As shown in FIGS. 3 and 4 each of the clip elements (40) comprise a pair of relatively elongated spring loaded normally closed jaws (41) which are pivotally connected together as at (42); and, provided on their lower end with an apertured coupling (43), which is adapted to receive a conventional D-ring connector (44), which forms the operative engagement between the clip element (40) and the tether member (20).

Figure 5:
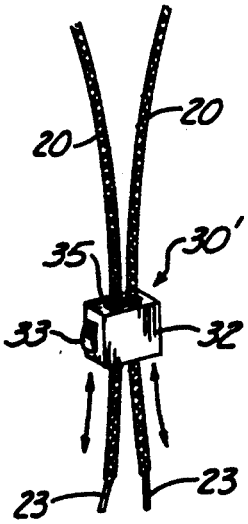

Turning now to FIGS. 4 and 5 it can be seen that this invention contemplates the use of two different types of slide members (30) (30') to operatively connect the flexible tether members (20) together. In the first version depicted in FIG. 4, the slide member (30) comprises a generally thin flat apertured slide element (31) provided with a pair of discrete apertures (34) which are dimensioned to slideably receive the finished ends (23) of the tether members (20). In the other version depicted in FIG. 5, the slide member (30') comprises an enlarged slide housing (32) provided with a central bore (35) dimensioned to receive the finished ends (23) of the tether members (20); wherein, the housing (32) is provided with an eccentric locking cam element (33) which may be rotated into a locking engagement with the tether members (20) in a well recognized manner.

Turning now to FIGS. 1 through 3, it can be appreciated that the elongated jaws (41) on the clip members (40) are dimensioned to not only engage spaced locations on opposite sides of a scull cap (101) having a brim (102); but, at least one of the clip members (40) is also dimensioned to be engaged with a selected portion of another article of clothing (200). Furthermore, when both of the clip members (40) are engaged with the billed cap (101) the slide member (30) may be moved along the intermediate portions of the tether members (20) to provide a snug fit around the users head, so that the billed cap (100) will not be dislodged from the users person.

having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A retaining device for holding headwear on the head of a wearer; wherein the retaining device comprises:

a pair of elongated flexible tether members;

a slide member for operatively connecting the tether members together; and a clip member formed on one end of each of the tether members; wherein the clip members each comprise a pair of jaws pivotally connected to one another for captively yet releasably engaging said headwear at spaced locations.

2. The device as in claim 1; wherein, said slide member comprises: an apertured slide element provided with a pair of discrete apertures dimensioned to slideably receive the intermediate portions of said tether members.

3. The device as in claim 1; wherein, said slide member comprises: a slide housing having at least one bore dimensioned to slideably receive said tether members; and, a locking element associated with said at least one bore for captively retaining the tether members relative to said housing.

4. The device as in claim 1; wherein, said jaws are spring loaded into a normally closed position.

* * * * *